US005833228A

United States Patent [19]

Nagata et al.

[11] Patent Number: 5,833,228

[45] Date of Patent: Nov. 10, 1998

[54] VACUUM SHEET FEEDING APPARATUS INCLUDING CYLINDER AND UPSTANDING NOZZLES

[75] Inventors: Jinichi Nagata, Osaka; Toshiro Kurishita, Nara; Toshiya Mikita, Yao, all of Japan

[73] Assignee: Sharp Kabushiki Kaisha, Osaka, Japan

[21] Appl. No.: 641,182

[22] Filed: Apr. 30, 1996

[30] Foreign Application Priority Data

May 8, 1995 [JP] Japan ..... 7-109471

[51] Int. Cl.[6] ..... B65H 5/08

[52] U.S. Cl. ..... 271/11; 271/10.03; 271/107; 271/108; 271/265.02

[58] Field of Search ..... 271/11, 12, 14, 271/10.03, 10.16, 107, 108, 265.02, 265.01, 259, 99

[56] References Cited

U.S. PATENT DOCUMENTS

| | | | |
|---|---|---|---|
| 2,770,458 | 11/1956 | Halahan et al. | 271/11 X |
| 2,995,360 | 8/1961 | Simpson | 271/107 |
| 3,218,061 | 11/1965 | Raanow | 271/11 |
| 3,764,133 | 10/1973 | Gray et al. | 271/107 X |
| 4,168,829 | 9/1979 | Wilson et al. . | |
| 4,171,130 | 10/1979 | Jeschke et al. | 271/10.03 |
| 4,516,763 | 5/1985 | Stahl et al. | 271/11 |
| 4,573,673 | 3/1986 | Haug | 271/265.02 X |
| 4,937,622 | 6/1990 | Makiura | 271/259 X |
| 5,028,043 | 7/1991 | Karolyi | 271/99 X |
| 5,213,320 | 5/1993 | Hirota et al. | 271/11 |

FOREIGN PATENT DOCUMENTS

| | | |
|---|---|---|
| 1-112273 | 4/1989 | Japan . |
| 1-256431 | 10/1989 | Japan . |
| 3-30919 | 2/1991 | Japan . |

*Primary Examiner*—Boris Milef

[57] ABSTRACT

A vacuum high-speed feeding apparatus equipped structure for moving suction nozzles attached to a cylindrical body towards sheet feeding rollers. The application of suction force is suspended upon detection that a drawn sheet has been caught and its conveyance has been stated by feeding rollers. This is done by detection of a leading edge of the sheet by a first sensor. The cylindrical body is restored to its home position when feeding of the sheet by a given distance is detected by a second sensor. The suction force is again applied when passage of the rear edge of the sheet through the feeding rollers is detected by the first sensor.

4 Claims, 9 Drawing Sheets

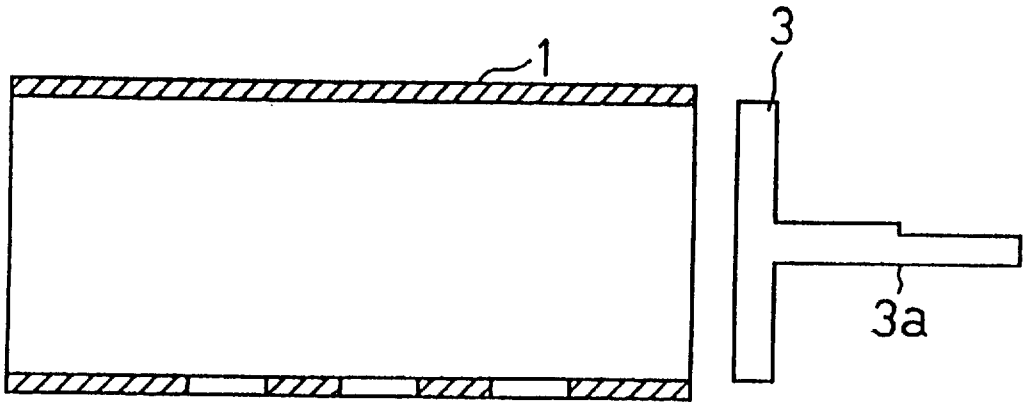
FIG. 2A
FIG. 2B
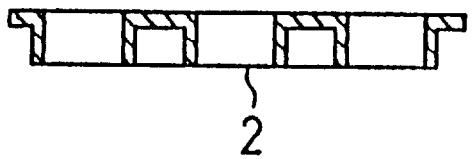
FIG. 2C
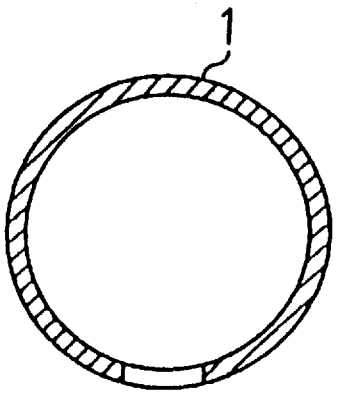
FIG. 2D
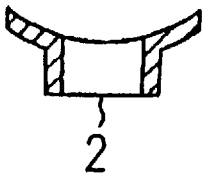
FIG. 2E

VACUUM SHEET FEEDING APPARATUS INCLUDING CYLINDER AND UPSTANDING NOZZLES

BACKGROUND OF THE INVENTION

1. Field of the Invention

The present invention relates to an air suction-type automatic document feeding apparatus (a vacuum sheet feeding apparatus) for use in electrophotographic, electronic printing machines such as copiers and laser printers.

2. Description of the Related Art

Vacuum sheet feeding apparatuses are used in copiers, laser printers, etc. for high-speed, reliable sheet feeding. FIG. 8 through FIG. 10 are views illustrative of the configuration of a prior art vacuum sheet feeding apparatus (U.S. Pat. No. 4,168,829). In this sheet feeding apparatus, suction ports 126 are formed in the side of a cylindrical body 118 (hereunder referred to as "cylinder"), and these suction ports 126 directly (without nozzles) draw a sheet by suction force. Accordingly, the drawn sheet adheres to the cylinder 118. In FIG. 8, the cylinder 118 rotates clockwise. The bottom sheet of sheets S stacked on a setting station 112 is directly drawn by the suction ports 126, and conveyed to a sheet feeding roller 128 in the state adhering to the cylinder 118. The sheet caught by the sheet feeding roller 128 is then conveyed to the next position (in the direction indicated by "A" in FIG. 8). The cylinder is connected to a suction fan via a hollow, open-ended flange 124. The flange 124 is attached to a shaft-shaped frame (not shown) with a shaft supporting member at the end opposite the open end in a freely rotatable manner. In addition, the open end of the flange 124 is supported by the frame with a shaft supporting member as well.

In order to ensure steady sheet feeding with the configuration mentioned above, it is necessary to rotate the cylinder 118 smoothly, and for this reason, two recess sections are formed in the center sections of the cylinder 118, and sheet feeding ball bearings 130 are mounted in these recess sections (see FIG. 9). Since the ball bearings 130 are integrated with the cylinder 118 in this way, the cylinder 118 has a three-compartment configuration as shown in FIG. 10. This requires tightening by screws or press fitting subsequent to integration of the ball bearings 130, resulting in disadvantages of increased cost and an increased number of assembling steps. Furthermore, in order to ensure a satisfactory degree of strength with such a complicated configuration, the cylinder is made of aluminum heavier than resin. Therefore, the apparatus requires an increased driving force for its driving, and has an increased inertia force due to the increased weight and thus a poor response which makes it unsuitable for high-speed sheet feeding.

Therefore, it may be a reasonable solution to make the cylinder from a resin; nevertheless, construction of the cylinder with a resin presents the following problems. A first problem derives from the fact that a cylindrical resin product is usually molded in a split-cavity mold as a two-part product. Although this molding process is time-saving and inexpensive, since the resulting semicircle-section moldings must be joined into a cylinder, the process has a drawback in that the section of the resulting cylinder has a lower degree of roundness, and further the cylinder undergoes warping from the center of rotation with time. An additional problem is that the cylinder cannot operate normally while rotating or rocking if it has been constructed with poor precision. In addition, preparation of the cylinder with a resin presents the risk of generating static electricity due to friction with sheets, which therefore excessively adhere to the cylinder. This means that the poor releasability of the sheets from the cylinder nozzles disadvantageously damages the sheets due to friction between the sheets and the nozzles.

SUMMARY OF THE INVENTION

It is an object of the present invention to provide a vacuum sheet feeding apparatus which overcomes the problems mentioned above, by drawing sheets with the aid of suction force provided through nozzles and constructing the cylinder with a resin-made pipe formed by extrusion molding.

The vacuum sheet feeding apparatus according to the invention comprises:

- a sheet stack tray;
- feeding rollers provided at the front end of the sheet stack tray;
- a suction nozzle member provided above the front end of the sheet stack tray;
- nozzle-rocking means for rocking the suction nozzle member toward and away from the feeding rollers; and
- suction on/off means for applying and suspending application of suction force of the suction nozzle member,
- characterized in that the suction force of the suction nozzle member is applied to draw a sheet stacked on the sheet stack tray, the suction nozzle member is then moved toward the feeding rollers by the nozzle rocking means, and after the feeding rollers have begun to feed the drawn sheet, the application of suction force is suspended by the suction on/off means, and the suction nozzle member moved by the nozzle rocking means is restored to its home position.

The vacuum sheet feeding apparatus according to the invention is further characterized by comprising first sheet detection means and second sheet detection means provided downstream from the feeding roller, along the direction of feeding of sheets.

With the vacuum sheet feeding apparatus according to the invention, the suction on/off means is activated upon detection of feeding of a sheet by the first sheet detection means, to apply or suspend the application of the suction force.

With the vacuum sheet feeding apparatus mentioned above, the application of the suction force is suspended upon detection of the leading edge of a sheet by the first sheet detection means, and applied again at the instance the rear edge of the sheet is detected.

The vacuum sheet feeding apparatus according to the invention is characterized in that the nozzle rocking means rocks the suction nozzle member to move it from or restore it to its home position upon detection of the fed sheet by the second sheet detection means.

With the vacuum sheet feeding apparatus mentioned above, the nozzle rocking means restores the suction nozzle member to its home position upon detection of the leading edge of a sheet by the second sheet detection means.

The vacuum sheet feeding apparatus according to the invention is characterized in that the suction on/off means is constructed with a duct connected to the suction nozzle member, a fan for evacuating air from the duct, and a valve mechanism for opening and closing the duct.

With the vacuum sheet feeding apparatus according to the invention, the suction nozzle member is equipped with a cylindrical section, and nozzle sections provided in open sections formed in the side of the cylindrical section, with one end of the cylindrical section connected to the duct and the other end closed in a flange, the cylindrical section being supported by a shaft supporting member such as a bearing in a freely rotatable manner.

The vacuum sheet feeding apparatus mentioned above may further by characterized in that the cylindrical section has an inner diameter on the order of 38–48 mm.

The vacuum sheet feeding apparatus mentioned above may further be characterized in that the cylindrical section is constructed of a conductive material or has a conductive surface coating.

According to the present invention, when the suction force of the suction nozzle member provided above the front end of the sheet stack tray is applied by the suction on/off means, a sheet stacked on the sheet stack tray is drawn. Only the top (or bottom) sheet is easily drawn even if a plurality of sheets are stacked. After a sheet has been drawn, the suction nozzle member is moved toward the feeding rollers by the nozzle rocking means. The feeding rollers are provided ahead of the front end of the sheet stack tray. With this configuration, the feeding rollers begin to convey the sheet at the instance the leading edge of the sheet reaches the feeding rollers. The application of the suction force is then suspended by the suction on/off means, and the suction nozzle member moved by the nozzle rocking means is restored to its home position ready for subsequent drawing by suction.

Since the nozzle member is designed to draw a sheet as mentioned above, the area of contact between the sheet and the vacuum sheet feeding apparatus is reduced to minimize damage to the sheet due to friction, warping, etc. In addition, since the suction is applied or its application is suspended by the suction on/off means, the releasability between the vacuum sheet feeding apparatus and sheets is improved, and this results in both smooth feeding of sheets and reduced damage to the sheets.

According to the invention, the suction on/off means is constructed with a duct connected to the suction nozzle member, a fan for evacuating air from the duct, and a valve mechanism for opening and closing the duct. The fan rotates for suction at all times, and the valve mechanism controls (transfers and interrupts) the suction force to the duct. Since this allows much faster on/off control of the suction force than switching on or off of the fan, high-speed continuous sheet feeding may be achieved.

According to the invention, the suction nozzle member is constructed with a cylindrical section, and nozzle sections provided in open sections formed in the side of the cylindrical section. Since it is designed so that each sheet is drawn with the aid of suction through the provided nozzles, there is no chance of the sheet being brought into direct contact with the cylindrical section, thus preventing damage to the sheet and generation of frictional electricity.

The cylindrical section is designed to have an inner diameter on the order of 38–48 mm according to the invention.

According to the present invention, the cylindrical section is designed to be constructed of a conductive material or to have a conductive surface coating. This configuration prevents residual static electricity due to accidental contact and friction of the sheet with the cylindrical section, thus minimizing obstacles to the sheet feeding.

BRIEF DESCRIPTION OF THE DRAWINGS

Other and further objects, features, and advantages of the invention will be more explicit from the following detailed description taken with reference to the drawings wherein:

FIG. 2(A)–2(E), hereinafter referred to as FIG. 2, are cross sectioinal views illustrative of the configuration of a nozzle-type cylinder for use in a vacuum sheet feeding apparatus according to the invention;

DETAILED DESCRIPTION OF THE PREFERRED EMBODIMENTS

Figure 1:
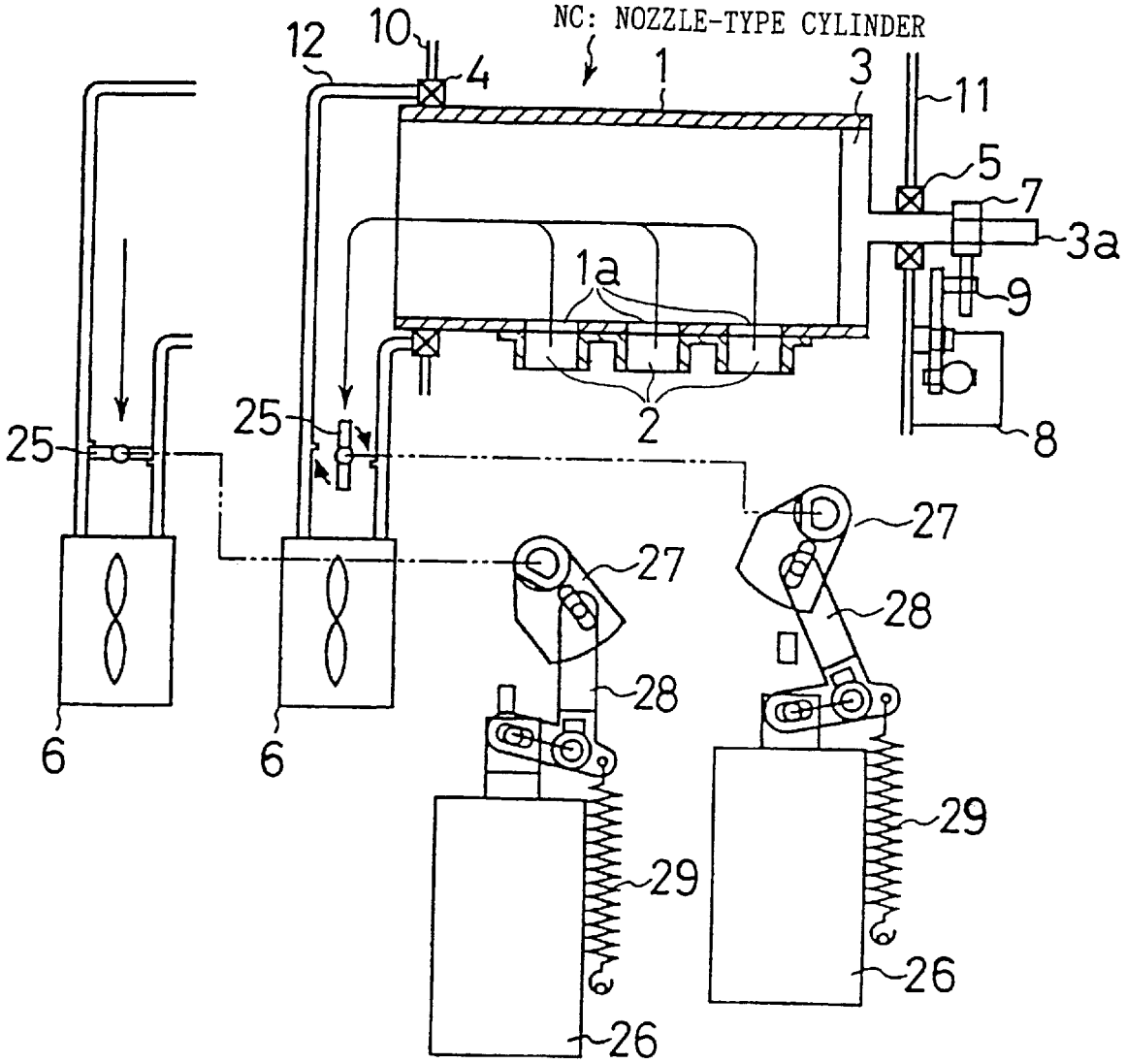
FIG. 1 is a schematic view of the main portion of a vacuum sheet feeding apparatus according to an embodiment of the present invention.

Now referring to the drawings, preferred embodiments of the invention are described below.

FIG. 1 is a schematic view illustrative of a nozzle-type cylinder NC and its peripheral equipment, in a vacuum sheet feeding apparatus according to an embodiment of the present invention. The nozzle cylinder NC comprises a cylindrical body 1, a nozzle 2 and a flange 3. The cylindrical body 1 is a cylinder with a plurality of (three in the drawing) side open sections 1*a* formed in its side, arranged in parallel with its axis. One end (right-hand end in the drawing) of the cylindrical body 1 is connected to the flange 3. A rotating shaft 3*a* extends from the center of the flange 3. The nozzle-type cylinder NC is supported, in a freely rotatable manner, between frames 10 and 11 by a shaft supporting member 4 provided at the other end (left-hand end in the drawing) of the cylindrical body 1, and a shaft supporting member 5 provided around the rotating shaft 3*a*. Here, the shaft supporting members 4 and 5 are constructed of bearings.

Figure 3:
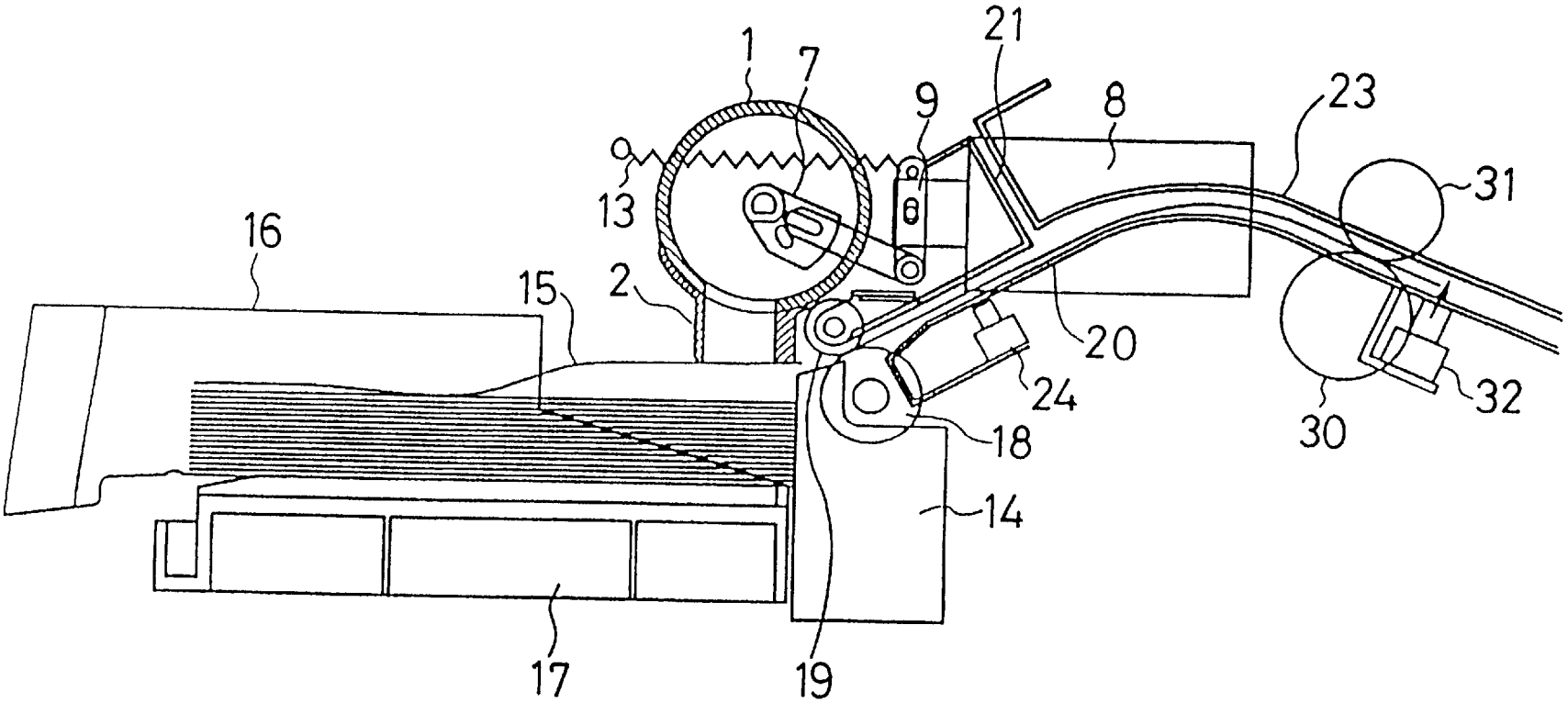
FIG. 3 is a view illustrative of the operating state of a vacuum sheet feeding apparatus according to the invention.
Figure 4:
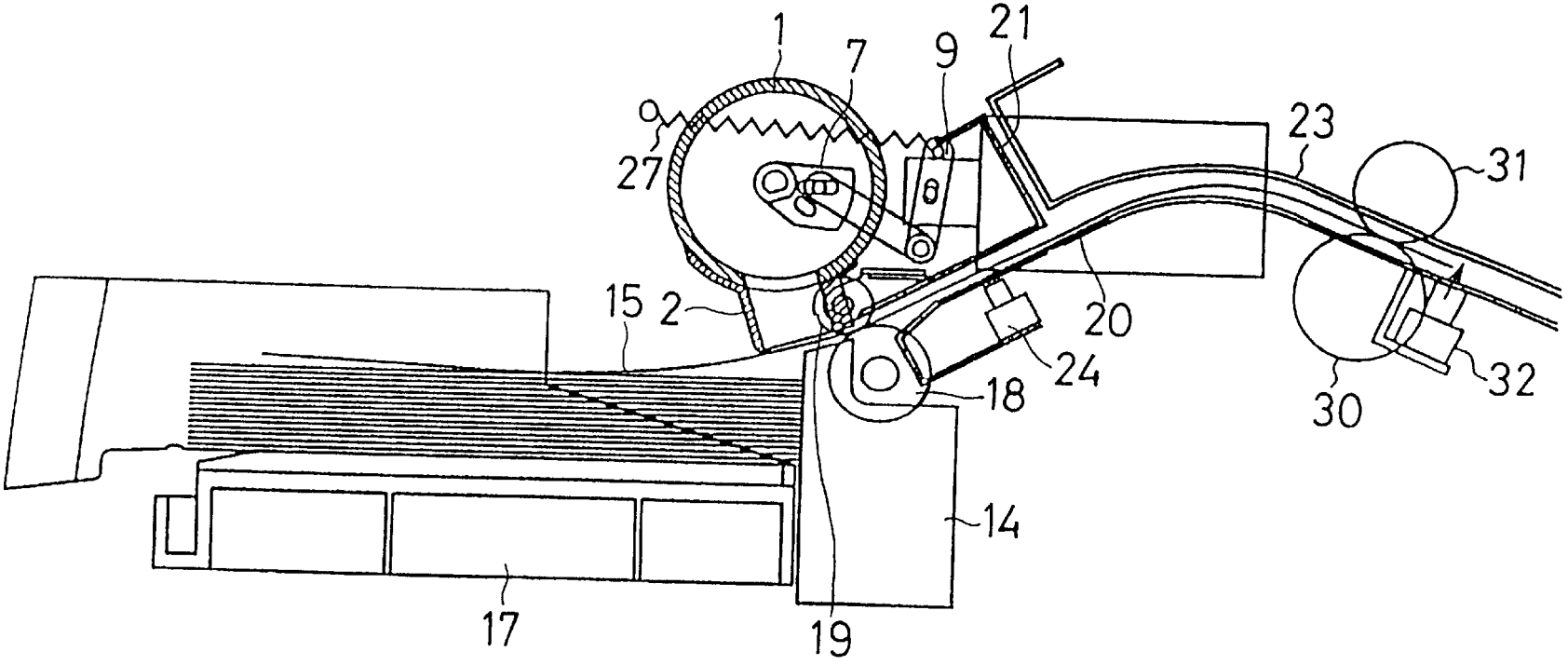
FIG. 4 is another view illustrative of the operating state of a vacuum sheet feeding apparatus according to the invention.

The other end of the cylindrical body 1 is held open, and a fan duct 12 is connected to the open end. A suction fan 6 is provided at the opposite end of the fan duct 12. This suction fan 6 rotates to suck out air from the fan duct 12. The end of the fan duct 12 at the cylinder side is kept in intimate contact with the frame 10 or the shaft supporting member 4 to maintain the hermetic state. With the configuration mentioned above, the air in the fan duct 12 and the cylindrical body 1 is sucked toward the suction fan 6 as the suction fan 6 rotates. This results in lower air pressure in the cylindrical body 1 to introduce external air through the side open sections 1*a*. The smoke stack-shaped nozzles 2 are provided around the side open sections 1*a*. As shown in FIG. 3 and FIG. 4, since these nozzles 2 are brought into contact with sheets placed on the sheet stack tray, the top sheet of the sheets is drawn by the nozzles 2.

A valve 25 is provided in the fan duct 2 in order to speedily apply (air) suction force or suspend its application by the suction fan 6 while rotating the suction fan 6. This valve 25 is opened and closed by a valve solenoid 26, arms 27, 28 and a coil spring 29.

A cylinder arm 7 is connected to the rotating shaft 3*a* of the flange 3. Since the cylinder arm 7 is fitted in a notch section of the rotating shaft 3*a*, the rotating force is conveyed to the cylinder without slipping. The cylinder arm 7 is connected with the cylinder solenoid 8 via a solenoid arm 9. The solenoid arm 9 is rocked while interlocked with the motion of the cylinder solenoid 8. This rocking motion is conveyed to the cylinder arm 7. The cylinder arm 7 is rocked in the opposite direction, interlocked with the rocking motion of the solenoid arm 9. This rocking motion is conveyed to the nozzle-type cylinder NC via the rotating shaft 3*a*. Here, the configurations and the motions of the valve solenoid 26, the arms 27 and 28, and the coil spring 29 are almost the same as the configurations and the motions of the cylinder solenoid 8, the cylinder arm 7, the solenoid arm 9 and the coil spring 13 provided for the nozzle-type cylinder NC.

FIG. 2 is a view illustrative of a sectional configuration of the nozzle-type cylinder NC. The cylindrical body 1 is constructed of a seamless, cylindrical pipe made of a resin such as ABS, PS, acryl, nylon or polyacetal by extrusion molding, with a plurality of side sections 1*a* formed in the side of the cylindrical pipe for air suction. The side open sections 1*a* are aligned in a row along the axis of the cylindrical pipe. The cylindrical body 1 is open at both ends, one of which is blocked with the flange 3. The flange 3, formed by injection molding or cutting operation, is constructed with a disc matching the inner diameter of the cylindrical body 1, and the rotating shaft 3*a* perpendicularly protruding from the center of the disc. The disc is closely fitted in one of the open ends of the cylindrical body 1, and the section of contact is fixed with an adhesive, by welding, with screws or otherwise. The nozzles 2 are placed at such positions that their openings match the side open sections 1*a* formed in the side of the cylindrical body 1. The nozzles 2 are approximately 1 cm high, smoke stack-shaped, injection-molded, resin-made protrusions standing on the side of the cylindrical body 1. The connection of the nozzles 2 and the cylindrical body 1 are ensured with an adhesive, by welding, with screws or otherwise.

FIG. 3 and FIG. 4 are views illustrative of the configuration and the sheet feeding operation of the sheet feeding cylindrical apparatus mentioned above. FIG. 3 shows the state at the start of sheet feeding, and FIG. 4 shows the state at the start of sheet feeding by a first feeding roller 18.

A plurality of sheets 15 are stacked on a sheet stack tray 17. The stacking position of the sheets 15 is controlled by a sheet head guide 14 and a sheet size guide 16 for all the edges to even up the edges of all the sheets. While the cylinder solenoid 8 is deactivated, the nozzle-type cylinder NC is at rest, with the nozzles 2 directed straight downward (toward the sheet stack tray) due to the elastic force of the coil spring 13.

Above the sheet head guide 14, there are provided a first feeding roller 18 and a first feeding collar 19 for feeding of sheets supplied by the cylinder, with a first photosensor 24 provided downstream from and adjacent to the first feeding roller 18 for detection of the start of sheet conveyance. In addition, sheet feeding guides 21, 22 and 23 for controlling the direction of sheet feeding are provided downstream from the first feeding roller 18 and the first feeding collar 19. On the sheet feeding guides 20 and 23, there are provided a second feeding roller 30 and a second feeding collar 31 for assuming conveyance of the supplied sheet, and a second photosensor 32 for detection of the arrived sheet.

At the start of sheet feeding, the valve solenoid 26 is first deactivated to open the valve 25 by the elastic force of the coil spring 29. This results in conveyance of the suction force of the suction fan 6 to the nozzles 2. The top sheet of the stacked sheets 15 is drawn by the nozzles 2 by this suction force. The cylinder solenoid 8 is driven upon adsorption of the sheet. The cylinder is shifted from the state of FIG. 3 to the state of FIG. 4 as a result of driving the cylinder solenoid. This shift results in the leading edge of the sheet 15 drawn by the nozzles 2 being caught between the first feeding roller 18 and the first feeding collar 19. This catch triggers the sheet 15 to be released from the nozzles 2 and to be fed along the sheet feeding guides 21, 22 and 23 by the conveying force of the first feeding roller 18 and the first feeding collar. When the leading edge of the sheet 15 fed in this way reaches the position of the photosensor 24, the photosensor 24 detects the arrival. The valve solenoid 26 is deactivated to close the valve 25 upon receipt of the detection signal. Then, when the sheet 15 is further conveyed, and its leading edge reaches the position of the photosensor 32 to activate it, the cylinder solenoid 8 is deactivated upon receipt of the detection signal. Deactivation of the cylinder solenoid 8 causes the nozzle-type cylinder NC to be restored to the position shown in FIG. 3 for feeding the next sheet. In contrast, for feeding continuous paper, when the rear end of the sheet 15 passes the position of the photosensor 24 to deactivate the photosensor 24, a non-detection signal is generated to deactivate the valve solenoid 26 to thereby resume suction through the nozzles, and when the rear end of the sheet passes the position of the photosensor 32 to deactivate the photosensor 32, a non-detection signal is generated to deactivate the photosensor 32, a non-detection signal is generated to activate the cylinder solenoid 32 to thereby rock the cylinder, thus initiating the process of feeding the next sheet.

Figure 5:
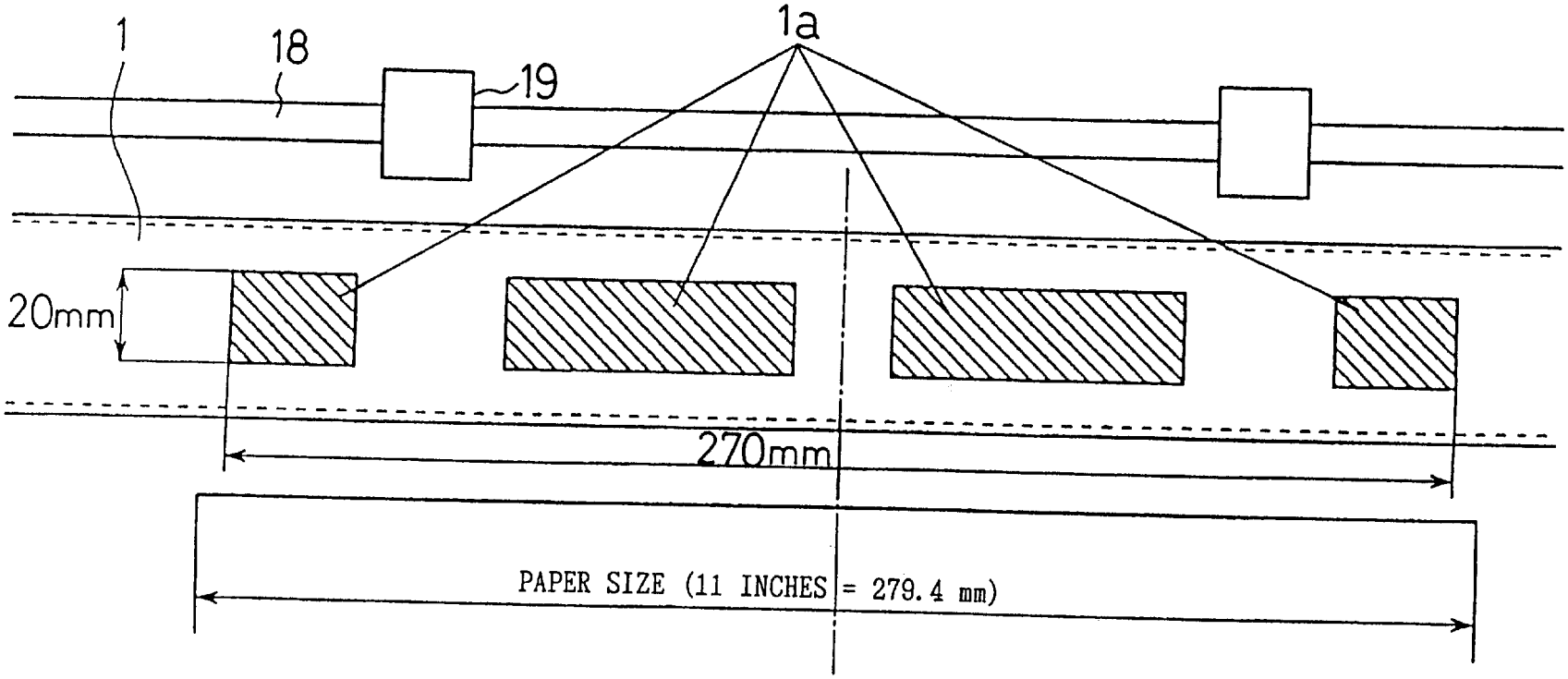
FIG. 5 is a view illustrative of an example of the open sections of the nozzle-type cylinder of FIG. 2.

FIG. 5 is a view illustrative of examples of the side open sections la of the cylindrical body 1. Although three each of side open sections la and nozzles 2 are provided at equal spacings along the cylindrical body 1 in FIG. 1 through FIG. 4 for simplicity of explanation, they may be configured as shown in FIG. 5. The drawing illustrates an embodiment of the cylindrical apparatus for feeding eleven-inch (279.4 mm)-sized sheets. The distance between the far-left side and the far-right side of the side open sections la is designed in such a manner that the two sides are located inward about a few mm from the sides of the sheets, taking care that the side open sections are not located facing the first feeding collar 19 and the center of the paper. The side open sections 1*a* are not located at locations facing the first feeding collar 19, because the first feeding collar 19 may collide nozzles provided at those positions when the cylinder is rocked. The side open sections are also not located at locations facing the center of the sheets, first, in order to ensure the junction between the nozzles 2 and the cylindrical body 1, and second, to avoid extreme reduction in the air pressure in the open section located farthest from the suction fan due to the excessively increased open area of a particular open section.

An explanation will now be given regarding optimum air pressure and inner diameter of the cylindrical body 1 for the suction with reference to FIG. 6(A) and FIG. 6(B).

Figure 6A:
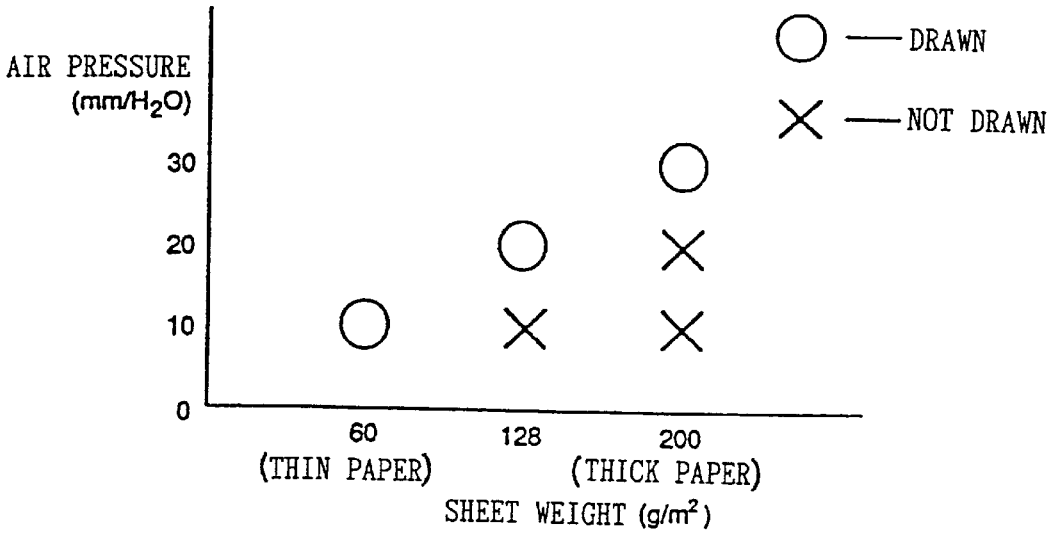
FIG. 6(A) is a graph illustrative of the relationship between the weight of a sheet and the air pressure in the nozzle-type cylinder.
Figure 6B:
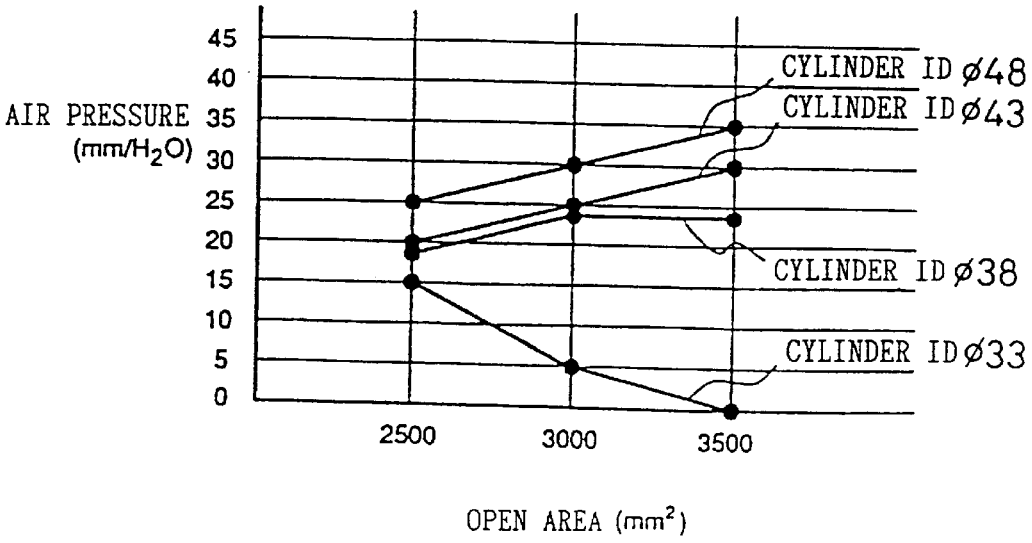
FIG. 6(B) is a graph illustrative of the relationship between the weight of a sheet and the area of the open sections of the nozzle-type cylinder, plotted against various inner diameters of the cylindrical body of the nozzle-type cylinder.

FIG. 6(A) is a view illustrative of the relationship between the sheet weight and the air pressure in the nozzle-type cylinder. Referring to the drawing, assuming that the distance between the nozzles 2 and the upper end of the sheet 15 is 10 mm, it is understood that the air pressure must be approximately 20 mm.$H_2O$ in order to draw thick paper of 128 g/$m^2$ which is a standard in the industry. The distance between the nozzles 2 and the sheet 15 is set to 10 mm for the reason that greater distances require increased air pressures, whereas smaller distances result in drawing of a plurality of sheets, and thus around 10 mm is believed to be an appropriate distance.

FIG. G(B) illustrates the relationship between the open area of the side open sections 1*a* and the air pressure in the nozzles for various inner diameters of the cylindrical body 1 when a common fan motor is used as the suction fan 6. Referring the drawing, it is understood that the cylindrical body 1 must have an inner diameter within the range of 38–48 mm in order to maintain an air pressure of 20 mm.$H_2O$ in cases where the open area of the side open sections 1*a* is 3,000 $mm^2$ or greater (approximately 3,500 $mm^2$ in the case of FIG. 5).

The wall thickness of the cylindrical body 1 is designed to be approximately 1 mm in order to avoid its deformation due to suction caused by air pressure at such levels as mentioned above. Smaller wall thicknesses tend to cause its deformation, whereas greater wall thicknesses may result in a considerably heavier weight of the cylindrical body, which requires increased driving forces and results in poor response.

Figure 7:
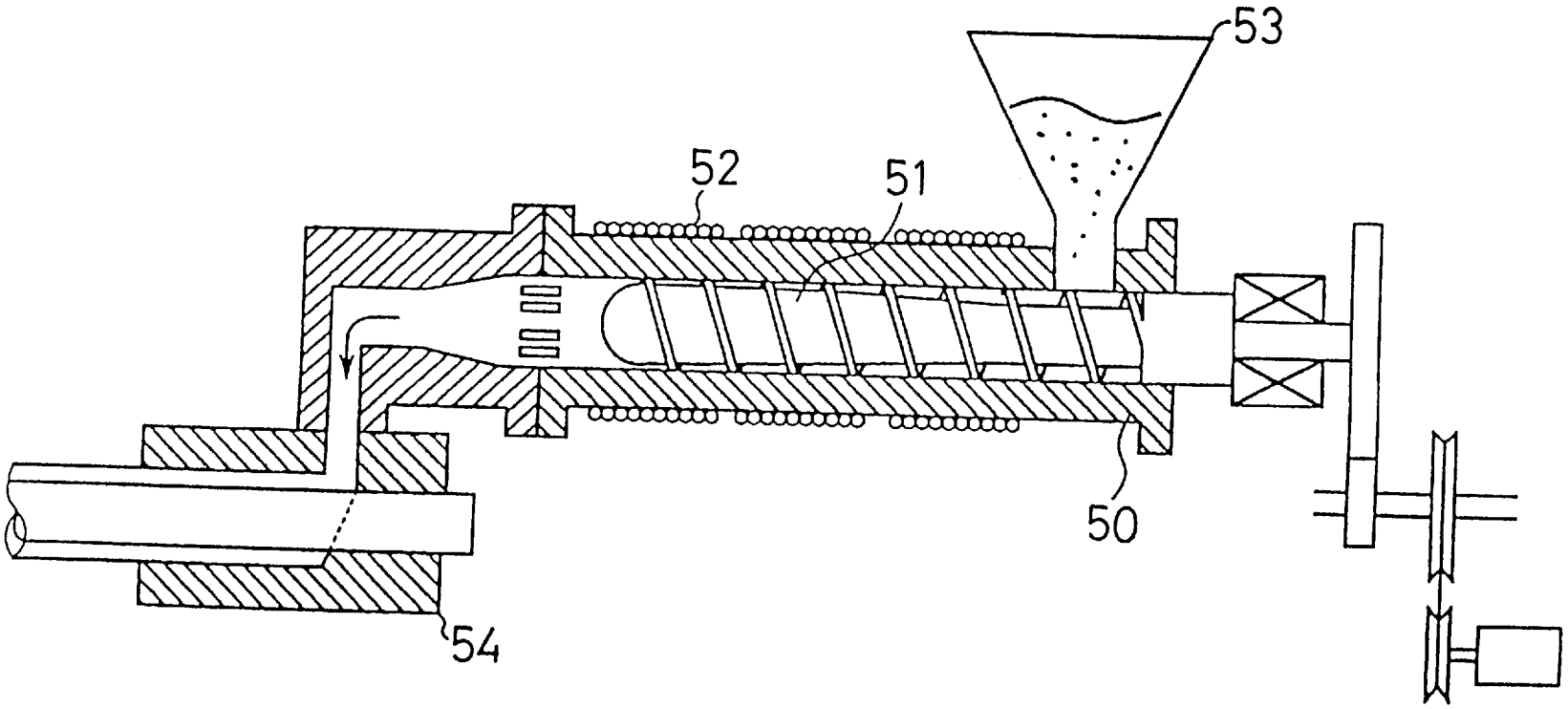
FIG. 7 is a schematic view, partly in section, illustrative of an example of extrusion molding equipment for producing the cylindrical body.
Figure 8:
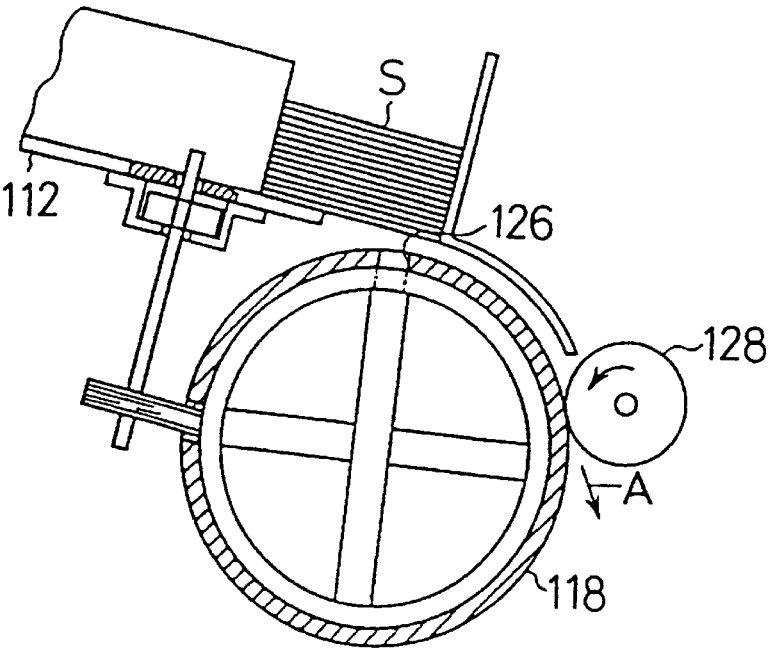
FIG. 8 PRIOR ART
FIG. 8 is a side view, partly in section, illustrative of a vacuum sheet feeding apparatus according to the prior art.
Figure 9:
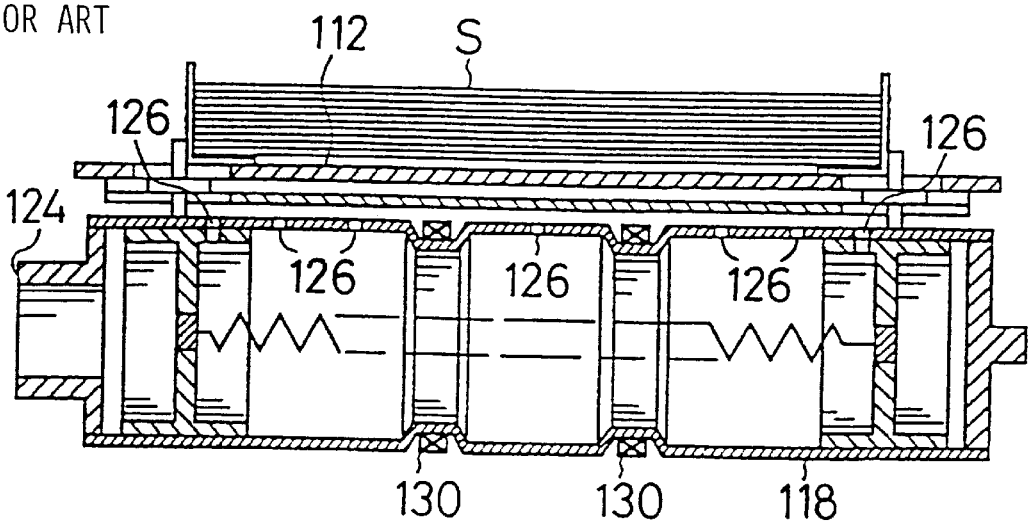
FIG. 9 PRIOR ART
FIG. 9 is a front view, partly in section, illustrative of the vacuum sheet feeding apparatus according to the prior art.
Figure 10:
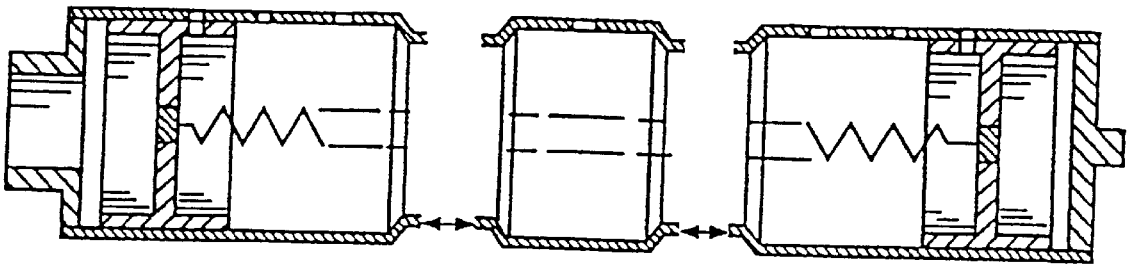
FIG. 10 PRIOR ART
FIG. 10 is a schematic diagram illustrative of a method of assembling a cylinder for use in the vacuum sheet feeding apparatus shown in FIG. 8 and FIG. 9.

FIG. 7 is a view, partly in section, illustrative of the configuration of an example of an extrusion molding machine for preparing the cylindrical body 1. A resin material supplied to a barrel 50 from a hopper 53 is melted in the barrel 50 heated by a heater 52, and is pressed and conveyed by rotation of a screw 51 inserted in the barrel 50. A die 54 as the extrusion mold is attached to the tip of the barrel 50. In FIG. 7, the attached die 54 is for extrusion of pipes. Extrusion of the melted and compressed resin material through the extrusion machine (barrel 50) via the die 54 results in successive molding of seamless pipes. Resin-made pipes with an inner diameter of 38 mm and a wall thickness of 1 mm may be prepared by selection of a properly sized die 54. The raw material is ABS, PS, PC, acryl, nylon, polyacetal, etc., and the melting temperature is 200° to 300° for ABS.

The preparation of the cylindrical body by extrusion molding as mentioned above provides a cylindrical body with a uniform quality and excellent roundness. In this way, there are provided high precision products to be exactly fitted in shaft supporting members such as bearings.

Preferably the nozzles 2 and the cylindrical body 1 have conductive surface coatings so that static electricity produced between the sheets is conducted to the frame via the shaft supporting members (bearings) 4 and 5. In addition, the entire nozzles 2 and the entire cylindrical body 1 may be constructed of a conductive resin.

As described above, according to the present invention, a vacuum sheet feeding apparatus may be configured in such a manner that application of the suction force is suspended upon detection that a drawn sheet has been caught and its conveyance has been initiated by feeding rollers through detection of the leading edge of the sheet by a first sensor, the cylindrical body is restored to its home position when feeding of the sheet by a given distance is detected by a second sensor, and the suction force is again applied when passage of the rear edge of the sheet through the feeding roller is detected by the first sensor.

Accordingly, since the cylindrical body is designed to be restored to its home position upon detection of a given-distance conveyance of a sheet by the second sensor, unlike the case where the cylindrical body is designed to be restored immediately after the sheet is held by the feeding roller, no opposite force is exerted on the sheet being fed through the open rear end of the restoring cylindrical body, thus ensuring reliable feeding of sheets. In addition, since the suction force is again applied after detection of the rear edge of the sheet by the first sensor, the rear edge of the already forwarded sheet cannot be caught again by the suction force of the cylindrical body.

Since the area of contact between sheets and the vacuum sheet feeding apparatus is minimized according to the invention, damage to the sheets due to friction or warping is prevented, and further the releasability between the vacuum sheet feeding apparatus and sheets is increased to facilitate feeding of sheets.

According to the invention, since the suction force is applied or its application is suspended by a valve mechanism, the suction force may be applied and its application may be suspended speedily, and thus sheets may be successively fed at high speeds.

In addition, since nozzles are provided according to the invention to draw sheets by suction, the sheets cannot be brought into direct contact with the cylindrical body, and therefore damage to the sheets and generation of frictional electricity may be prevented.

Furthermore, since the suction nozzles constructed according to the invention are lightweight, the required driving force is minimized, and thus optimum high-speed sheet feeding is established. As an additional advantage of the invention, the appropriate wall thickness of the cylindrical body provides resistance to twisting.

In addition, since generation of static electricity is prevented, and excellent releasability between the suction nozzle member and sheets is provided according to the invention, damage to the sheets due to rubbing between the nozzles and the sheets is prevented.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A vacuum sheet feeding apparatus comprising:

a sheet stack tray;

feeding rollers provided at the front end of the sheet stack tray;

a cylinder having holes provided above the front end of the sheet stack tray;

an upstanding suction nozzle member with orifices;

means for connecting the upstanding suction nozzle member to the cylinder, so that the holes are aligned with the orifices;

nozzle rocking means for rocking the upstanding suction nozzle member toward and away from t-he feeding rollers;

suction on/off means for applying and suspending application of suction force of the upstanding suction nozzle member, wherein the suction force of the upstanding suction nozzle member is applied to draw a sheet stacked on the sheet stack tray, the suction nozzle member is then moved toward the feeding rollers by the nozzle rocking means, and after the feeding rollers have begun to feed the drawn sheet, the application of suction force is suspended by the suction on/off means, and the upstanding suction nozzle member moved by the nozzle rocking means is restored to a position from which the suction nozzle member has moved, and first sheet detection means, for detecting sheets, located downstream from the feeding rollers and second sheet detection means, for detecting sheets, located downstream from the feeding rollers, along a direction of feeding of sheets, wherein the nozzle rocking means rocks the suction nozzle member to move the suction nozzle member from an original position thereof or restore the suction nozzle member to the position from which the suction nozzle member has moved upon detection of the fed sheet by the second sheet detection means.

2. The vacuum sheet feeding apparatus according to claim 1, wherein the nozzle rocking means restores the suction nozzle member to the position from which the suction nozzle member has moved upon detection of the leading edge of a sheet by the second sheet detection means.

3. A vacuum sheet feeding apparatus comprising:

a sheet stack tray;

feeding rollers oppositely opposed to one another, provided at the front end of the sheet stack tray;

a suction nozzle member provided above the front end of the sheet stack tray;

nozzle rocking means for rocking the suction nozzle member toward and away from the feeding rollers;

suction on/off means for applying and suspending application of suction force of the suction nozzle member, wherein the suction force of the suction nozzle member is applied to draw a sheet stacked on the sheet stack tray, the suction nozzle member is then moved toward the feeding rollers by the nozzle rocking means, and after the feeding rollers have begun to feed the drawn sheet, the application of suction force is suspended by the suction on/off means, and the suction nozzle member moved by the nozzle rocking means is restored to a position from which the suction nozzle member has moved, and first sheet detection means for detecting paper located downstream and spaced from the feeding rollers and second sheet detection means located downstream and spaced from the feeding rollers along the direction of feeding sheets, wherein the nozzle rocking means rocks the suction nozzle member to move the suction nozzle member from an original position thereof or restore the suction nozzle member to the position from which the suction nozzle member has moved upon detection of the fed sheet by the second sheet detection means.

4. The vacuum sheet feeding apparatus according to claim 3, wherein the nozzle rocking means restores the suction nozzle member to the position from which the suction nozzle member has moved upon detection of the leading edge of a sheet by the second sheet detection means.

* * * * *